United States Patent [19]

Kobayashi

[11] 4,098,069

[45] Jul. 4, 1978

[54] DIGITAL CLOCK WITH TIMER

[75] Inventor: Toshiji Kobayashi, Takamori, Japan

[73] Assignee: Iida Sankyo Co., Ltd., Japan

[21] Appl. No.: 734,396

[22] Filed: Oct. 21, 1976

[30] Foreign Application Priority Data

Oct. 21, 1975 [JP] Japan ..... 50-126790

[51] Int. Cl.[2] ..... G04B 13/00

[52] U.S. Cl. ..... 58/21.11; 58/16 R; 58/126 R; 58/152 R

[58] Field of Search ..... 58/16 R, 16 D, 16.5, 58/21, 21.1, 21.11, 19 R, 20, 22, 22.5, 23 AC, 85.5, 152, 23 R, 127, 126, 145; 235/104

[56] References Cited

U.S. PATENT DOCUMENTS

| | | | |
|---|---|---|---|
| 2,783,835 | 3/1957 | Poole | 58/126 R |
| 3,708,973 | 1/1973 | Funaki | 58/16 D |
| 3,925,917 | 12/1975 | Concha C | 58/152 R |

*Primary Examiner*—Robert K. Schaefer
*Assistant Examiner*—Leonard W. Pojunas, Jr.
*Attorney, Agent, or Firm*—McGlew and Tuttle

[57] ABSTRACT

The digital clock includes a switch which undergoes a first operation at a first time and a second operation, representing a resetting operation, at a second time, the first and the second time being preset on a timer of the digital clock by utilizing a conventional clock mechanism contained in the digital clock. A manually operable device is provided for enabling a manual operation of the switch prior to the occurrence of the first and the second times. Additionally, a device is provided which is operable, responsive to the occurrence of the first time, for resetting the condition of the switch resulting from any manual operation thereof and for disabling a further manual operation thereof, so as to cause the switch to operate in accordance with the time schedule determined by the timer.

8 Claims, 16 Drawing Figures

DIGITAL CLOCK WITH TIMER

BACKGROUND OF THE INVENTION

The invention relates to a digital clock having a timer which is driven by connection with a movable part of the digital clock for operating an electrical equipment, such as a radio set, in accordance with an arbitrarily preset time schedule.

A timer in a conventional digital clock is capable only of performing either on or off operation of the switch at a given instant of time, and maintains the operative state once the switch operation takes place. As a consequence, a radio set can be automatically turned on at a desired time, but it cannot be automatically turned off at another desired time.

SUMMARY OF THE INVENTION

It is an object of the invention to provide a first operation of the switch at a first given time and a second operation of the switch, representing a resetting operation, at a second given time by utilizing a digital clock.

Another object is to enable a manual operation of the switch prior to the occurrence of the first and second times while resetting a switch condition, resulting from any manual operation thereof and disabling a further manual operation, upon occurrence of the first time or through a separate manual operation.

In accordance with the invention, a digital clock comprises a disc-shaped timer dial to which the rotation of a rotating element contained in a clock mechanism is transmitted, a suitable number of sets of time presetting pieces adapted to be disposed on the periphery of the timer dial for rotation therewith as aunit but angularly adjustable relative thereto, the pieces including projections having different paths of rotation, an on and off cam extending into the paths of rotation of the projections so as to be driven thereby, and a switch cam disposed in coaxial relationship with the on and off cam for rotation as a unit therewith for alternately opening and closing a timer switch. In accordance with another aspect of the invention, the on and off cam can be manually displaced in the axial direction to be locked or unlocked. In accordance with a further aspect of the invention, the switch cam is divided into a pair of axially separated sections which are phase displaced from each other and which are joined by a smooth inclined surface so that they may be manually displaced axially to be locked and unlocked either manually or automatically.

With the digital clock with timer according to the invention, an accurate timer operation is assured by directly utilizing the drive available in a digital clock which is generally known to be free from failure and as having a high time accuracy. The time display provided by the timer can be precisely adjusted in response to an adjustment of a time adjusting knob. The combination of the timer dial, the suitable number of sets of time presetting pieces and a timer unit including the on and off cam or the like permits a first operation of the switch to take place in response to the occurrence of a first preset time and a second operation or a resetting operation of the switch to take place in response to the occurrence of a second preset time. If desired, a manual operation of the switch is permitted prior to the occurence of the first and second times. Additionally, the timer unit may be rendered inoperative if desired. The timer is integrally incorporated into the clock to provide convenience in use.

DETAILED DESCRIPTION OF EMBODIMENTS

Figure 1:
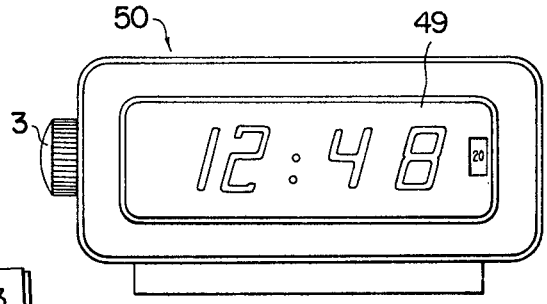
FIG. 1 is a front view of a digital clock with timer constructed in accordance with one embodiment of the invention.
Figure 2:
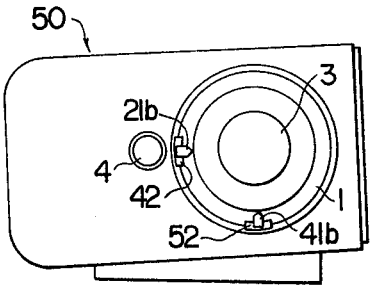
FIG. 2 is a side elevation, view thereof as viewed from the lefthand side of FIG. 1.

Referring to FIG. 1, there is shown a digital clock 50 having a time display window 49 formed in its front surface. As shown in FIG. 2, a disc-shaped timer dial 1 and a time adjusting knob 3, having a diameter less than that of the dial, are rotatably mounted on the left-hand side of the casing of the clock 50, the dial 1 and the knob 3 being concentrically disposed and rotatable relative to each other. A manual button 4 is mounted on the same side of the casing adjacent to the dial 1 for permitting a manual operation, of a switch to be described later, as desired. A plurality of time presetting pieces 42, 52, having grooves therein, are slidably mounted around the periphery of the timer dial 1 by axially straddling the peripheral edge thereof. A set of pointers 21, 41, to be further described later, are fitted into the grooves of the pieces 42, 52, the hook portions **21*b*, 41*b* at the free ends of these pointers overlying the pieces 42, 52**.

Figure 3:
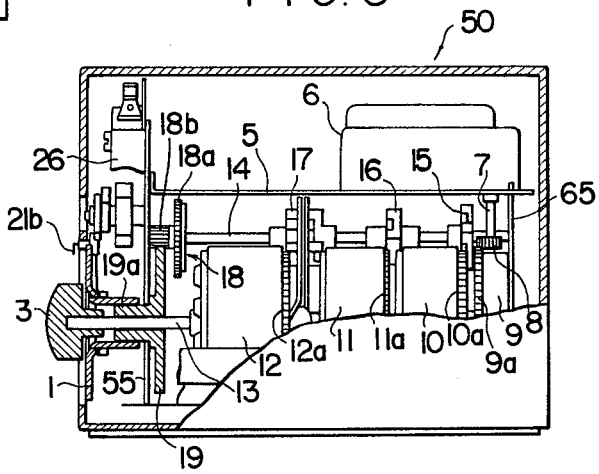
FIG. 3 is a plan view, partly cutaway, of the digital clock shown in FIG. 1.

As indicated in FIG. 3, the clock 50 internally includes a frame which is essentially comprised of a longitudinal plate 5 and a pair of transverse plates 55, 65 which are integrally joined with the plate 5. Fixedly mounted on the rear side of the plate 5 is an electric motor 6 having its output shaft 7 extending through the plate 5 in the forward direction and fixedly carrying a gear 8 on its end. A time adjusting shaft 13 is rotatably mounted in the plates 55, 65, with a hollow shaft or hub **19*a* of a timing gear 19 (see FIG. 4) interposed between the shaft 13 and the opening in the vertical plate 55. Progressing from right to left as viewed in FIG. 3, a "second" display wheel 9, a unit's minute display wheel 10, a ten's minute display wheel 11 and an hour display wheel 12 are mounted on the shaft 13. Only the unit's minute display wheel 10 is integrally connected with the shaft 13 while the remaining display wheels are rotatably mounted on the shaft 13. A toothed wheel 9***a* is formed on the left-hand edge of the "second" display wheel 9 while toothed wheels 10*a*, 11*a* and 12*a* are formed on the right-hand edge of the remaining display wheels 10, 11 and 12, respectively. The toothed wheel 9*a* on the "second" display wheel 9 meshes with the gear 8 on the output shaft 7 of the motor 6.

At a position adjacent to the plate 5, a time advance shaft 14 is rotatably mounted in and extends between, the plates 55, 65 in parallel relationship with the time adjusting shaft 13. A plurality of carry pinions 15, 16 and 17 is mounted on the advance shaft 14, and an intermediate gear 18, comprising a gear 18*a* and another gear 18*b* of a reduced diameter integral therewith, is also mounted on the shaft 14. The pinion 16 and the gear 18 are fixedly connected with the shaft 14 while the pinions 15 and 17 are rotatable relative to the shaft 14. Each of the pinions 15, 16 and 17 is capable of a carry operation by a meshing engagement between a projection on one of the adjacent display wheels and a gear on the other display wheel, as is well known in conventional digital clocks. Specifically, the rotation of the shaft 7 of the motor 6 is transmitted through the gears 8, 9*a* to cause the "second" display wheel 9 to rotate continuously at a rate of one revolution per minute. The pinion 15 experiences an angular movement through a given angle for each revolution of this display wheel. The rotation of the pinion 15 is transmitted to the unit's minute display wheel 10 for causing a rotation thereof through a given angle so that a next following numeral thereon is caused to be displayed. When the numeral display on the unit's minute display wheel 10 has been changed ten times, or after ten minutes has passed, the pinion 16 acts to rotate the ten's minute display wheel 11 through a given angle to advance one numeral position thereon. In the similar manner, when the display wheel 11 has advanced through six numeral positions, or after one hour has passed, the hour display wheel 12 advances to the next numeral position. The display numerals on the individual wheels are visible through the display window 49 shown in FIG. 1. Because the pinion 16 is integral with the shaft 14, the shaft 14 rotates through a given angle as the pinion 16 rotates, or for each increment of ten minutes, thus causing a rotation of the intermediate gear 18 through a given angle.

Figure 4:
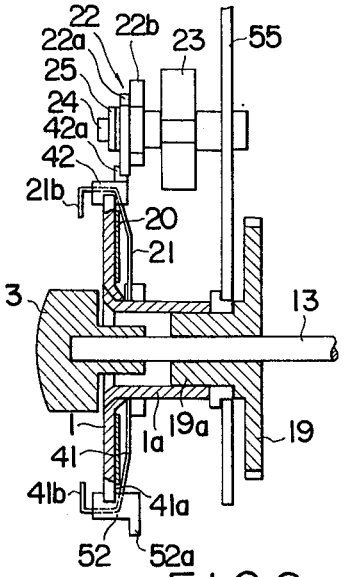
FIG. 4 is an enlarged view of the timer unit shown in FIG. 3.
Figure 5:
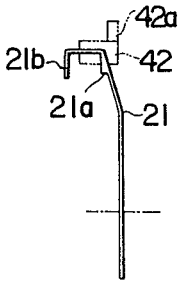
FIG. 5 is an enlarged view of a pointer shown in FIG. 4.

The gear 18*b* of reduced diameter meshes with the timing gear 19 mentioned above. The gear 19 is rotatably mounted by having its integral hollow shaft or hub 19*a* loosely fitted in an opening formed in the plate 55. As shown in FIG. 4, the timer dial 1 has a hollow shaft or hub 1*a* which is fitted on the hollow shaft or hub 19*a* whereby the gear 19 and the dial 1 are fixedly connected with each other. It will be understood that the timer dial 1 is driven by the shaft 14 through the gear train 18*b*, 19 to rotate through one revolution in 12 or 24 hours, and the outer surface of the timer dial 1 carries a time scale corresponding to the period of time which is required for its one revolution. A gear 20 of a reduced thickness is integrally mounted on the inner surface of the dial 1 in concentric relationship therewith, and the space between adjacent teeth of the gear 20 is engaged by barbs 21*a*, 41*a* of the pointers 21, 41 which latter are formed of a resilient material (see FIGS. 4 and 5). The free ends 21*b*, 41*b* of the pointers 21, 41 are bent outwardly to be fitted into the grooves in the time presetting pieces 42, 52 before being bent to extend along the dial 1. At their opposite ends, the pointers 21, 41 are shaped in an annular configuration so as to be rotatably fitted on the hollow shaft or hub 1*a* of the dial 1, and an axial movement of these pointers is prevented, as by a ferrule to hold the barbs 21*a*, 21*b* against the dial 1.

The time presetting pieces 42, 52 are shaped so as to straddle the peripheral edge of the dial 1 along its thickness, and are formed integrally with triangular projections 52*a*, 42*b* extending radially of the shaft 13. These pieces 42, 52 are adapated to rotate as a unit with the dial 1, while maintaining their preset relative positions thereon, as the dial 1 is driven for rotation from the shaft 14 through the gears 18*b*, 19 during the operation of the described digital clock mechanism.

Figure 7:
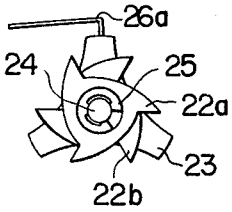
FIG. 7 is an enlarged view of a cam assembly shown in FIG. 6.

As shown in FIG. 4, a shaft 24 is fixedly mounted on the plate 55 at a position rearwardly of the shaft 13, and rotatably carries an on and off cam 22 and a switch cam 23, the on and off cam 22 comprising an on cam portion 22*a* and an off cam portion 22*b*. The cam portions 22*a*, 22*b* and the switch cam 23 are integral with each other. These cams are locked against withdrawal by a ring 25. As indicated in FIG. 7, the cam portions 22*a*, 22*b* are formed like a windmill, having three cam lobes, and are integrally connected together with a phase displacement of 60° from each other. One of the three cam lobes of the on cam portion 22*a* extends into the path of rotation of the projection 42*a* on the piece 42 while one of the three cam lobes of the off cam portion 22*b* extends into the path of rotation of the projection 52*a* on the piece 52. The switch cam 23 comprises three projections and recesses located therebetween, and a cantilever operating arm 26*a* of a switch, for example, a microswitch 26, which is secured to the plate 55, is located on the path of rotation of these projections.

As shown in FIGS. 3 and 4, the left-hand end of the time adjusting shaft 13 extends through the hollow shafts or hubs 19*a*, 1*a* of the time gear 19 and the timer dial 1 to the exterior of the casing of the digital clock, and receives the time adjusting knob 3 which is secured thereto. It is to be understood that an adjustment is previously made such that, when the projection 42*a* on the piece 42 bears against the on cam portion 22*a*, the time indicated on the timer dial 1 by the hook portion 21*b* of the pointer 21 coincides with the time displayed through the window 49.

In operation, a power source, not shown, is connected with the motor 6 to set it in motion. Then the digital clock mechanism operates in the manner mentioned previously, providing a time display through the display window 49 with the progress of the time. When the time displayed through the window 49 is not in coincidence with the true time, the time adjusting knob 3 may be turned to provide a proper adjustment. As the knob 3 is turned, the shaft 13 and the unit's minute display wheel 10 rotate, and the rotation of these members is transmitted, through a carry assembly including the pinions 16, 17, to the ten's minute display wheel 11 and the hour display wheel 12. On the other hand, the rotation of the pinion 16 is transmitted to the timer dial 1 through the shaft 14 and the gears 18*b*, 19. In this manner, the knob 3 may be turned until a correct time is displayed through the window 49.

When it is desired to turn on the switch 26 automatically at a desired time, the hook portion 21*b* of the pointer 21 is axially displayed to disengage the barb 21*a* from the gear 20. While maintaining such condition, the pointer 21 is moved angularly around the periphery of the dial 1 together with the piece 42, and the hook portion 21*b* of the pointer is released when it assumes a position on the dial 1 in which it indicates a desired time at which the switch 26 is to be turned on. Thereupon the barb 21*a* on the pointer again engages the space between adjacent teeth of the gear 20. In order to automatically reset or turn off the switch 26 at another desired time, the hook portion 41*b* of the pointer 41 is pushed to turn the pointer 41, and it is released at a position on the dial 1 that indicates the desired time when the switch 26 is to be turned off.

After the times at which the switch is to be operated are determined in this manner, the timer dial 1 rotates together with the pieces 42, 52 and the pointers 21, 41 during an operation of the clock mechanism including the display wheels 9 to 12. When the piece 42 enters the path of rotation of the on cam portion 22*a*, the projection 42*a* on the piece 42 engages one of the cam lobes of the on cam portion 22*a* to rotate it through 60°. Since the on cam portion 22*a* is integral with the off cam portion 22*b* and the switch cam 23, one of the projections of the switch cam 23 engages the cantilever arm 26*a* of the switch 26 to turn the switch 26 on. With a further progress of time, when the piece 52 enters the path of rotation of the off cam portion 22*b*, the projection 52*a* on the piece 52 engages one of the cam lobes of the off cam portion 22*b* to rotate the off cam portion 22*b*, and hence its integral on cam portion 22*a* and the switch cam 23, through 60°, whereby the cantilever arm 26*a* of the switch 26 falls down into a recess between the projections of the switch cam 23, thus resetting the switch 26 or turning it off.

With the timer mentioned above, it is possible to receive and/or record a radio broadcast over a given time interval without manual intervention. Thus, a radio set and a tape recorder may be connected with a power source through the switch 26, and the hook portion 21*b* of the pointer 21 aligned with a time indication on the timer dial 1 corresponding to the time at which the desired program is to be commenced and the hook portion 41*b* of the other pointer 41 aligned with a time indication on the timer dial 1 which indicates the time at which the program is to be terminated. In this manner, a given program which occurs daily can be recorded automatically.

During the operation of the timer, it may be desired to temporarily change the switch position or to render it inoperative. By way of example, it may be desired to turn on the switch earlier than it is preset to become on by the timer, or it may be desired to turn off the switch during the on time of the timer. If this is achieved by moving the pointers 21, 41, the subsequent time at which the switch is to be opened or closed will change, requiring a repeated setting of these pointers when it is desired again to provide an automatic switch operation during a given time interval. The use of other relay switches involves an inconvenience that the timer operation cannot occur unlesss these relay switches, once operated, are reset. In order to eliminate such inconveniences, it is possible to employ a modification as mentioned below.

Figure 8:
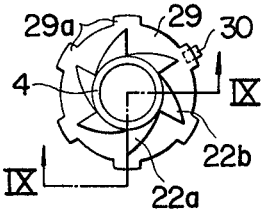
FIG. 8 is a side elevation view of a cam assembly used in a second embodiment of the invention.
Figure 9:
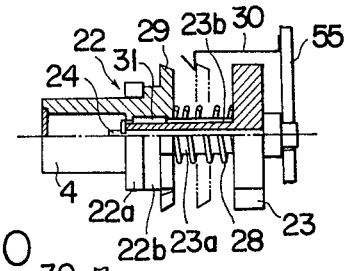
FIG. 9 is a cross section, view partly in side elevation, taken along the line IX—IX shown in FIG. 8.

Referring to FIGS. 8 and 9, there is shown a modification which renders the timer mechanism inoperative to allow a continued operation which is currently prevailing. In this arrangement, manual button 4 is integrally connected with the on and off cam 22, and is located externally of the digital clock. The switch cam 23 is disconnected from the on and off cam 22, and a locking cam 29 is integrally provided on the rear surface of the on and off cam 22. The locking cam 29 is provided with projecting teetch 29*a* in alignment with the respective cam lobes of the on and off cam 22, with the end faces of the teeth 29*a* being bevelled to provide a conical surface having its apex on the rear side of the cam 29. The switch cam 23 is provided with a hollow shaft or hub 23*a* loosely extending through the locking cam 29 and the on and off cam 22, and a key 31 is received in a keyway 23*b* formed in the hollow shaft 23*a* and a corresponding keyway formed in the cams 29, 22 so that the cams 29, 22 are slidable relative to the switch cam 23 along the length of the shaft 24 but rotate about the shaft 24 as a unit with the cam 23. A coil spring 28 is disposed between the cam 23 and the cam 29 to bias the cams 29, 22 axially outward. However, the resulting movement is limited by a suitable locking ring. A leaf spring 30 has its one end secured to the plate 55 and passes by the side of the cam 23. The free end of the spring is bent so as to extend into the path of movement of the teeth 29*a* on the cam 29.

Assume that the switch cam 23 is not engaged with the cantilever arm 26*a* of the switch 26, which therefore remains off. When the manual button 4 is pushed inward along the shaft 24, the cams 22, 29 which are integral with the button 4 also slide inward against the resilience of the spring 28. After urging the free end of the leaf spring 30 outward with one of its teeth 29*a*, the cam 29 reaches a position shown in phantom line in FIG. 9, whereupon the free end of the leaf spring 30 locks the teeth 29*a* on the cam 29 and prevents a returning movement of the cams 29, 22 and the button 4 which might take place under the resilience of the spring 28. Under this condition, the on cam portion 22*a* and the off cam portion 22*b* of the cam 22 are moved out of the path of rotation of the pieces 42, 52, respectively, so that the timer cannot operate. Hence, the switch 26 remains off.

To reset the timer, the button 4 is turned about the shaft 24 to disengage the teeth 29*a* from the leaf spring 30, whereby the cams 29, 22 and the button 4 are allowed to return to their original position under the resilience of the spring 28. Subsequently, the timer operates in accordance with the preset time schedule. When maintaining the switch 26 on independently from the action of the timer while the switch cam 23 engages the cantilever arm 26*a* of the switch 26, the operation takes place in a manner similar to that mentioned above. The switch can be changed from on to off or vice versa by turning the button 4 through 60° without pushing it inward.

Figure 10:
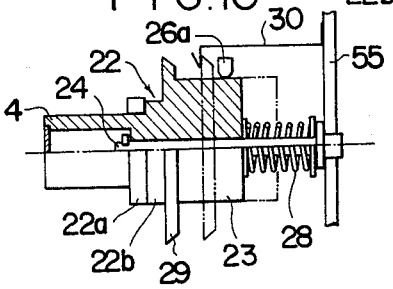
FIG. 10 is a view similar to FIG. 9 of a third embodiment of the invention.

FIG. 10 shows another embodiment of the invention which permits the currently prevailing condition to be continued by rendering the timer inoperative. The switch cam 23 is integrally formed with the locking cam 29, the on and off cam 22 and the button 4, and the switch cam 23 has a thickness which is greater than a stroke through which the button 4 is pushed inward. The coil spring 28 is interposed between the switch cam 23 and the plate 55. In other respects, the arrangement is similar to the embodiment shown in FIGS. 8 and 9. With this mechanism, the locking cam 29 can be locked by the leaf spring 30 and, when the locking cam is locked, the on cam portion 22*a* and the off cam portion 22*b* are located out of path of rotation of the pieces 42, 52 so that the currently prevailing condition can be continued by rendering the timer inoperative as in the previous embodiment.

Referring to FIGS. 11 to 16, an arrangement will be described which permits a manual switching from on to off condition or vice versa when the switch actuating times are preset on the timer. Initially referring to FIGS. 11 to 13, the manual button 4 is mounted on the shaft 24 in an axially slidable and rotatable manner relative thereto, and includes a sleeve 4*a* on the rear end of which are fixedly and concentrically mounted a first switch cam 23*a*, having three projections joined by arcuate recesses, as well as a second switch cam 23*b* of the same configuration and size as the first switch cam and serving also as a locking cam, with the first and second switch cams being angularly displaced 60° from each other and disposed in concentric manner. Formed on the rear part of the switch cam 23*a* is an inclined surface 23*c* which smoothly engages with a recess in the switch cam 23*b*. An on and off cam 22 is loosely fitted on the hollow shaft 4*a* of the button 4, but the cam 22 rotates with button 4 by virtue of a key 31 which is fitted into a keyway 4*b* formed in the hollow shaft 4*a* and a corresponding keyway formed in the cam 22. However, an axially stationary detent plate 32 prevents a sliding movement of the cam 22 in the axial direction of the shaft 24 while allowing a rotation thereof. The cams 23*a*, 23*b* and the button 4 are urged to the left, as viewed in FIG. 12, by the coil spring 28. When the cam 23*b* is urged to its left-most position under the resilience of the spring 28, the cantilever arm 26*a* of the switch bears against the cam edge of the cam 23*b*, but when the button 4 is axially pushed inward against the resilience of the spring 28, the cam 23*b* becomes locked by the bent free end of the leaf spring 30, whereby the cantilever arm 26*a* of the switch bears against the cam edge of the cam 23*a*.

Figure 12:
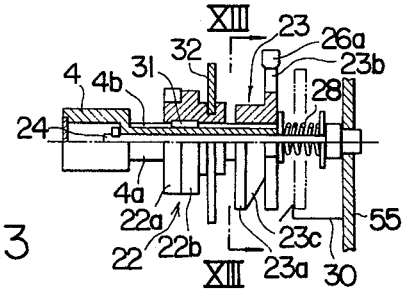
FIG. 12 is a cross section view taken along the line XII—XII shown in FIG. 11.

When the switch 26 (see FIGS. 3 and 6) assumes an on position with the cantilever arm 26*a* bearing against the projection of the switch cam 23*b* as shown in FIG. 12, the switch 26 will operate according to the time schedule preset by the pointers 21, 41 during a rotation of the timer dial 11 and the pieces 42, 52 (see FIGS. 3 and 6) as the clock mechanism operates. However, when it is desired to turn the switch 26 off manually at an earlier time while it assumes an on position, the button 4 is pushed inward against the resilience of the spring 28. Thereupon, the switch cams 23*a*, 23*b* slide axially until the projection of the cam 23*b* is locked by the leaf spring 30, whereby the cantilever arm 26*a* slides along the inclined surface 23*c* into a recess in the switch cam 23*a*, turning the switch 26 off. This condition is maintained until the timer dial 1, shown in FIGS. 3 and 6, rotates to cause the piece 52 to engage the off cam 22*b*. When the off cam 22*b* is angularly moved by the piece 52, the cam 23*b* is unlocked from the leaf spring 30, whereby the cams 23*a*, 23*b* and the button 4 return to their original position under the resilience of the spring 28. This results in the cantilever arm 26*a* resuming its relative opposing relationship with the switch cam 23*b*. However, since the cams 23*a*, 23*b* have been previously turned in the manner mentioned above, the switch 26 maintains its off condition. Subsequently, the timer operates according to the time schedule preset by the pointers 21, 41.

Figure 6:
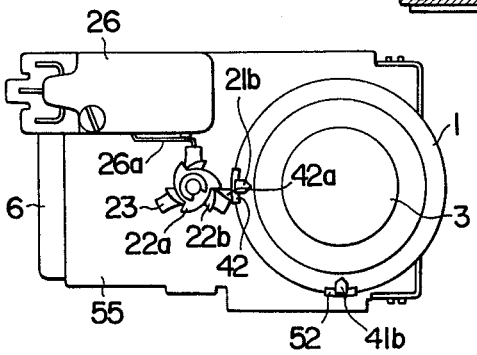
FIG. 6 is a side elevation, view as viewed from the lefthand side of FIG. 4.

In a similar manner, it is also possible to turn the switch on at an earlier time while the timer is in its off condition. Specifically, assuming that the cantilever arm 26*a* of the switch is in the recess of the cam 23*b* and hence assumes an off position, when the button 4 is pushed inward against the resilience of the spring 28, the cams 23*a*, 23*b* slide axially and the projection of the cam 23*b* is locked by the leaf spring 30. This causes the cantilever arm 26*a* to be raised along the inclined surface 23*c*, thereby turning the switch 26 on. This condition is maintained until the piece 42 drives the on cam 22*a* angularly during a subsequent rotation of the timer dial 1 (FIGS. 3 and 6). When the on cam 22*a* is angularly driven by the piece 42, the cam 23*b* is unlocked from the leaf spring 30, allowing the cams 23*a*, 23*b* and the button 4 to return to their original position. This results in the cantilever 26*a* resuming its relative position in which it opposes the switch cam 23*b*. However, since the cams 23*a*, 23*b* have been angularly driven, the switch 26 maintains its on condition. Subsequently, the timer operates according to the preset time schedule.

Figure 11:
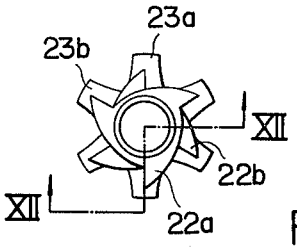
FIG. 11 is a side elevation view of a cam assembly which is used in a fourth embodiment of the invention.
Figure 13:
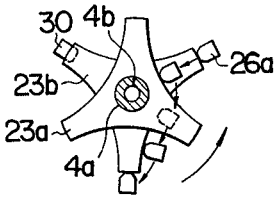
FIG. 13 is an end view, as viewed from a plane shown by the line XIII—XIII shown in FIG. 12.
Figure 14:
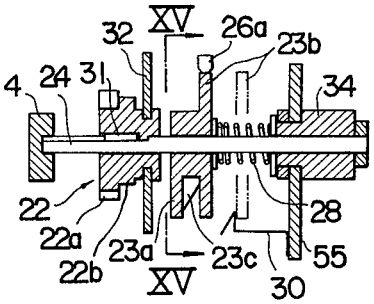
FIG. 14 is a longitudinal sectional view of a cam assembly used in a fifth embodiment of the invention.
Figure 15:
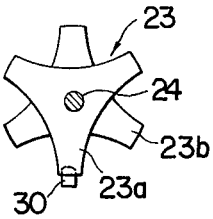
FIG. 15 is an end view, as viewed from a plane indicated by the line XV—XV shown in FIG. 14.
Figure 16:
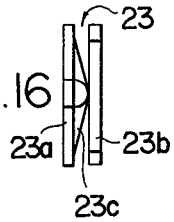
FIG. 16 is a right-hand side elevation view of FIG. 15.

FIGS. 14 to 16 show another embodiment of the mechanism which provides an earlier switching when the timer is preset. A sleeve 34 is received in an opening formed in the plate 55, and the shaft 24 is rotatably and axially slidably supported by the sleeve 34. A switch cam 23, which is similar to the corresponding switch cam shown in FIGS. 11 to 13, is fixedly mounted on the shaft 24 intermediate its ends, and the button 4 is fixedly mounted on the free end of the shaft 24. As in the embodiment of FIGS. 11 to 13, a key 31 fitted into corresponding keyways formed in the on and off cam 22 and the shaft 24, and an axially stationary detent plate 32 loosely fitted into a peripheral groove formed therein, allow a unitary rotation of the cam 22 with the shaft 24, and also allow a relative sliding movement of the shaft 24 while retaining the cam 22 at a fixed position. In other respects, the arrangement is similar to the previous embodiment and therefore will not be described in detail.

In a modification of the invention, it is also possible to provide a plurality of sets of pieces 42, 52, thereby repeating a plurality of on and off operations during one revolution of the timer dial 1.

While specific embodiments of the invention have been shown in detail to illustrate the application of the principles of the invention, it will be understood that the invention may be embodied otherwise without departing from such principles.

What is claimed is:

1. A digital clock with a timer, comprising, in combination, a digital clock mechanism including a rotating element; a disc-shaped timer dial rotatable by said element; at least one set of timer-presetting on pieces and timer-presetting off pieces disposed around the periphery of said timer dial for rotation as a unit therewith, said pieces being selectively angularly adjustable about the periphery of said timer dial to preset on and off times of said timer; said on presetting pieces and said off presetting pieces having respective projections rotatable in mutually different axially spaced rotation paths; a timer switch spaced from the periphery of said timer dial and having an operating arm; a shaft positioned between said timer dial and said timer switch and extending parallel to the axis of said timer dial; an angularly displaceable on cam and an angularly displaceable off cam rotatable on said shaft as a unit and each positioned in a respective one of said rotation paths for engagement and angular displacement by the respective projections of said on and off presetting pieces; and an angularly displaceable switch cam on said shaft, normally aligned with said switch operating arm, concentric with said on and off cams and rotatable as a unit therewith; said operating arm directly engaging said switch cam for operating said switch alternately to its on and off positions responsive to rotation of said on and off cams by the associated on and off presetting pieces.

2. A digital clock, with a timer, as claimed in claim 1, including a frame mounting said digital clock mechanism; and another shaft mounted in said frame and supporting said disc-shaped timer dial for rotation; said first-mentioned shaft being mounted in said frame parallel to said another shaft and spaced laterally therefrom.

3. A digital clock, with a timer, as claimed in claim 1, in which said on and off cams are integral with each other and constituted respectively by an on cam portion and an off cam portion of an on and off cam.

4. A digital clock, with a timer, as claimed in claim 1, and including externally accessible manual operating means selectively operable to displace said on cam and said off cam axially, of said shaft from an operative position in which said on cam and said off cam are each positioned in a respective one of said rotation paths, to an inoperative position, in which said on cam and said off cam are displaced out of their associated rotation paths to render said timer inoperative.

5. A digital clock, with a timer, as claimed in claim 4, including latch means operable, responsive to displacement of said on cam and said off cam to such inoperative position to retain said on cam and said off cam in said inoperative position; means biasing said on cam and said off cam toward their operative positions; and means operable, responsive to continued rotation of said timer dial, to release said latch means for return of said on cam and said off cam to such operative position.

6. A digital clock, with a timer, as claimed in claim 1, including a gear concentric and integral with said timer dial; and resilient pieces engageable between the teeth of said gear and each operatively engaged with a respective presetting piece for angular movement therewith.

7. A digital clock, with a timer, as claimed in claim 6, in which said pointers are resiliently displaceable out of engagement with said gear to provide for angular adjustment of the associated presetting pieces.

8. A digital clock, with a timer, as claimed in claim 1, in which said switch cam is axially displaceable on said shaft relative to said on and off cams, and divided into first and second axially spaced and integrally connected segments which are displaced angularly from each other and interconnected by a smooth inclined surface; said switch cam having an operative position in which said operating arm is engaged with said first segments and an inoperative position in which said operating arm is engaged with said second segment; means biasing said switch cam to its operative position; manually operable means operable to axially displace said switch cam to its inoperative position for engagememt of said switch operating arm with said second segment; and latch means operable to releasably latch said switch cam in its inoperative position; said latch means, responsive to continued rotation of said timer dial, releasing said switch cam for return to its operative position and said switch operating arm moving along said smooth inclined surface from engagement with said second segment back into engagement with said first segment.

* * * * *